US007887159B2

(12) United States Patent
Takei et al.

(10) Patent No.: US 7,887,159 B2
(45) Date of Patent: Feb. 15, 2011

(54) LIQUID EJECTING HEAD AND INK JET PRINTING APPARATUS

(75) Inventors: Yasunori Takei, Tokyo (JP); Shuichi Murakami, Kawasaki (JP); Kenji Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 12/126,720

(22) Filed: May 23, 2008

(65) Prior Publication Data

US 2009/0002447 A1 Jan. 1, 2009

(30) Foreign Application Priority Data

May 25, 2007 (JP) ..... 2007-139178

(51) Int. Cl.
*B41J 2/14* (2006.01)

(52) U.S. Cl. ..... 347/47; 347/40; 347/20

(58) Field of Classification Search ..... 347/20, 347/40, 44, 47
See application file for complete search history.

(56) References Cited

U.S. PATENT DOCUMENTS

| | | | | |
|---|---|---|---|---|
| 5,818,479 | A * | 10/1998 | Reinecke et al. | 347/47 |
| 6,123,413 | A * | 9/2000 | Agarwal et al. | 347/47 |
| 6,286,952 | B1 | 9/2001 | Ando | |
| 6,371,596 | B1 * | 4/2002 | Maze et al. | 347/47 |
| 6,520,626 | B1 * | 2/2003 | Murakami | 347/56 |
| 6,527,369 | B1 * | 3/2003 | Weber et al. | 347/47 |
| 7,258,408 | B2 | 8/2007 | Usuda | |
| 2005/0280669 | A1 * | 12/2005 | Nagata et al. | 347/43 |
| 2005/0285901 | A1 | 12/2005 | Nelson | |
| 2007/0146437 | A1 | 6/2007 | Murakami | |
| 2007/0188813 | A1 * | 8/2007 | Ozawa | 358/3.21 |

FOREIGN PATENT DOCUMENTS

| | | |
|---|---|---|
| EP | 958924 | 11/1999 |
| JP | 9-239986 | 9/1997 |
| JP | 10-235874 | 9/1998 |
| JP | 2001-171112 | 6/2001 |
| JP | 2006-130701 | 5/2006 |
| KR | 10-2004-0082281 | 9/2004 |
| WO | 2007/064021 | 6/2007 |

* cited by examiner

*Primary Examiner*—Ellen Kim
(74) *Attorney, Agent, or Firm*—Canon USA Inc IP Div

(57) ABSTRACT

The present invention provides a liquid ejecting head which inhibits the possible generation of satellites and possible inappropriate ejection during liquid ejection, enabling printing with improved image quality and reliability. Thus, ejection openings in the liquid ejecting head each selectively have projections or a circular shape depending on the characteristics of a liquid to be ejected.

2 Claims, 18 Drawing Sheets

LIQUID EJECTING HEAD AND INK JET PRINTING APPARATUS

BACKGROUND OF THE INVENTION

1. Field of the Invention

The present invention relates to a liquid ejecting head and an ink jet printing apparatus which eject a liquid for printing, and in particular, to a liquid ejecting head that inhibits sub-droplets from being generated during ejection.

2. Description of the Related Art

An ink jet printing system is known as a common scheme of ejecting a liquid such as ink to print a print medium. The ink jet printing system includes a method of utilizing electro-thermal converting elements (heaters) as ejection energy generating elements that allow the liquid to be ejected and a method of utilizing piezoelectric elements (piezo). Both types of elements are provided in a liquid ejecting head and can control ejection of droplets in accordance with electric signals.

To meet the recent demand for high-image-quality printing, much effort has been made to reduce the size of ejected droplets and to increase the number of nozzles provided in the liquid ejecting head. Consequently, the adverse effect, on printing, of droplets which are different from those ejected for printing and which do not contribute to printing is no longer negligible. Specifically, during ejection, droplets are separated into main droplets and sub-droplets (hereinafter also referred to as satellites). The main droplets impact the desired place on a print medium. However, the impact positions of the satellites cannot be controlled. With conventional low-image-quality printing, the satellites have almost no adverse effect on printing. However, with the present high-image-quality printing, the printing image quality may be markedly degraded by the satellites.

Furthermore, smaller satellites may lose speed before reaching the print medium and become floating ink droplets (hereinafter also referred to as mist). The mist may stain the printing apparatus. The stain on the printing apparatus may be transferred to the print medium, which may thus be stained.

To prevent printing image quality from being degraded, Japanese Patent Laid-Open Nos. 9-239986 and 10-235874 disclose a method of reducing the generation of satellites by forming noncircular ejection openings.

The shape of the ejection openings described in Japanese Patent Laid-Open Nos. 9-239986 and 10-235874 enables a reduction in the generation of satellites. However, when the noncircular ejection openings are designed to eject the same amount of liquid as that of corresponding circular ejection openings for comparison, the noncircular ejection openings are likely to be subjected to a greater flow resistance and thus inappropriate ejection because of the longer circumferential length thereof. In particular, a phenomenon is likely to occur in which ejection through the noncircular ejection openings becomes difficult a specified time after the start of ejection.

As described above, the reduction in the generation of satellites may be contradictory to the maintenance of the easiness with which ejection can be performed the specified time after the start of ejection. On the other hand, the generation of satellites and the easiness with which ejection is performed the specified time after the start of ejection also depend on the volume of ink (hereinafter sometimes simply referred to as the ejection amount). That is, even with the same shape of the ejection openings, the amount of satellites generated and the easiness with which ejection can be performed the specified time after the start of ejection may vary depending on the type of the ink. The generation of satellites and the easiness with which ejection can be performed the specified time after the start of ejection may also vary depending on the ejection amount.

SUMMARY OF THE INVENTION

It is desirable to provide a liquid ejecting head that makes it possible to optimize the balance between the inhibition of generation of satellites during liquid ejection and the inhibition of inappropriate ejection depending on the type of ink or the ejection amount.

A first aspect of the present invention can provide a liquid ejecting head as defined by claims 1 to 7 and 9 to 14

A second aspect of the present invention can provide an ink jet printing apparatus as defined by claim 8.

A third aspect of the present invention can provide a liquid ejecting head as defined by claim 15.

Embodiments of the present invention can make it possible to optimize the balance between the inhibition of generation of satellites during liquid ejection and the inhibition of inappropriate ejection depending on the type of ink or the ejection amount. This enables a reduction in the amount of mist generated. A liquid ejecting head can thus be provided which makes it possible to inhibit inappropriate ejection and to achieve printing with improved image quality and reliability.

Further features of the present invention will become apparent from the following description of exemplary embodiments (with reference to the attached drawings).

DESCRIPTION OF THE EMBODIMENTS

First Embodiment

A first embodiment of the present invention will be described below with reference to the drawings.

Figure 17:
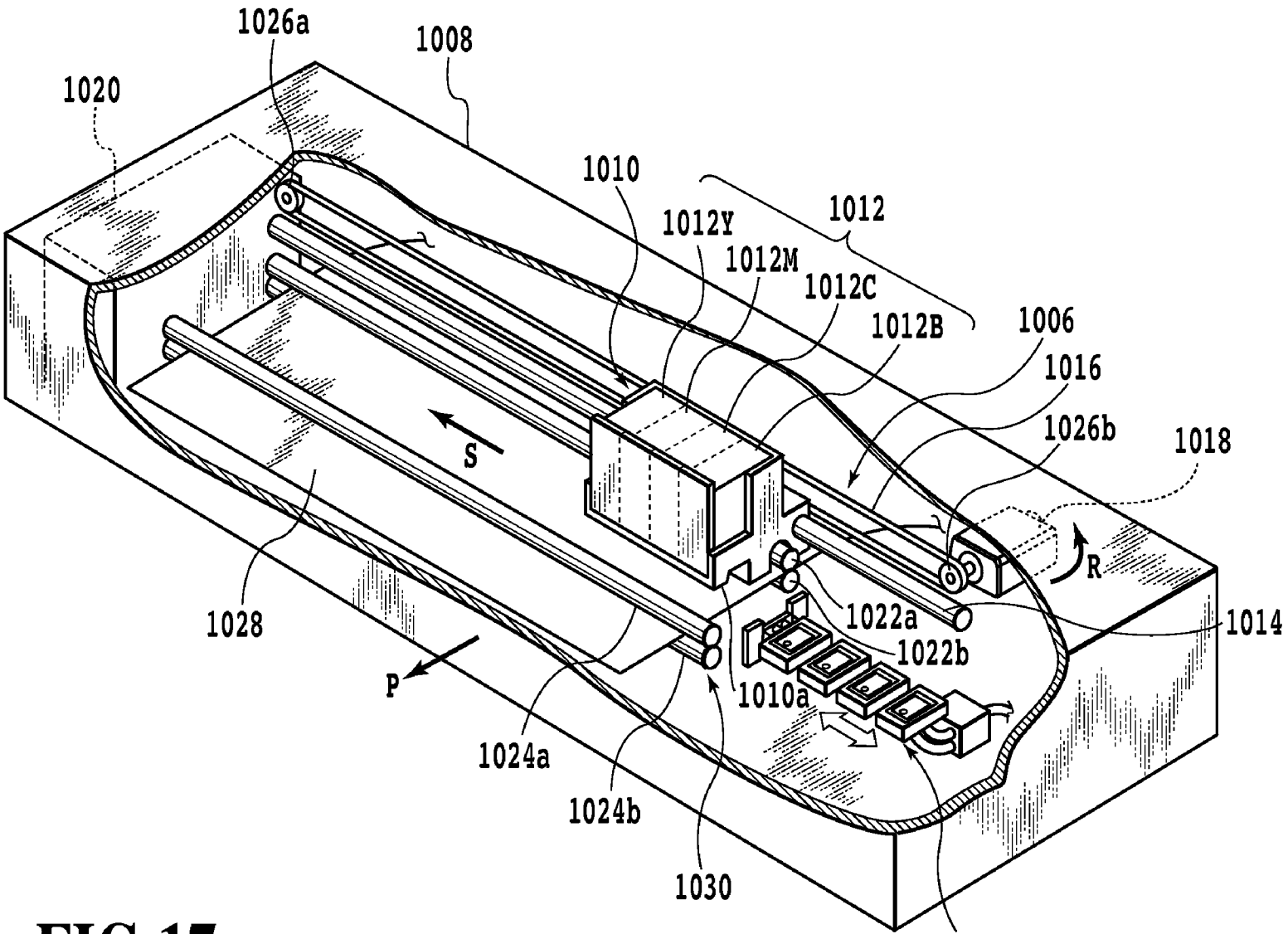
FIG. 17 is a schematic perspective view showing the liquid ejecting head according to the first embodiment and an essential part of an example of an ink jet printing apparatus serving as liquid ejecting apparatus and using the liquid ejecting head.

FIG. 17 is a schematic perspective view showing a liquid ejecting head according to the present embodiment and parts of an exemplary ink jet printing apparatus serving as liquid ejecting apparatus and using the liquid ejecting head. The ink jet printing apparatus comprises a conveying portion 1030 that conveys a sheet 1028 as a print medium in the direction of arrow P; the sheet 1028 is provided in a casing 1008 along a longitudinal direction. The ink jet printing apparatus includes a printing portion 1010 that is reciprocated substantially parallel to a direction S substantially orthogonal to the conveying direction P in which the sheet 1028 is conveyed by the conveying portion 1028, and a movement driving portion 1006 as driving means for reciprocating the printing portion 1010.

The conveying portion 1030 comprises a pair of roller units 1022*a* and 1022*b* arranged substantially parallel to and opposite each other, a pair of roller units 1024*a* and 1024*b*, and a driving portion 1020 that drives each of the roller units. Thus, while the driving portion 1020 is operative, the sheet 1028 is conveyed in the direction of arrow P by means of intermittent feeding while being sandwiched between the roller units 1022*a* and 1022*b* and between the roller units 1024*a* and 1024*b*.

The movement driving portion 1006 is located substantially parallel to the roller units 1022*a* and 1022*b*. The movement driving portion 1006 includes a motor 1018 that drives a belt 1016 forward and backward which is coupled to a carriage member 1010*a* of the printing portion 1010. When the motor 1018 is operative and the belt 1016 rotates in the direction of arrow R, the carriage member 1010*a* of the printing portion 1010 moves in a direction opposite to the direction of arrow S by a predetermined amount. Moreover, a recovery unit 1026 that executes an ejection recovering process is provided at one end of the movement driving portion 1006 at a position corresponding to a home position of the carriage member 1010*a*; the recovery unit 1026 is located opposite an arrangement of ink ejection openings.

The printing portion 1010 comprise ink jet cartridges (hereinafter also referred to as cartridges) 1012Y, 1012M, 1012C, and 1012B for respective colors such that the cartridges are removable from the carriage member 1010*a*.

Figure 15:
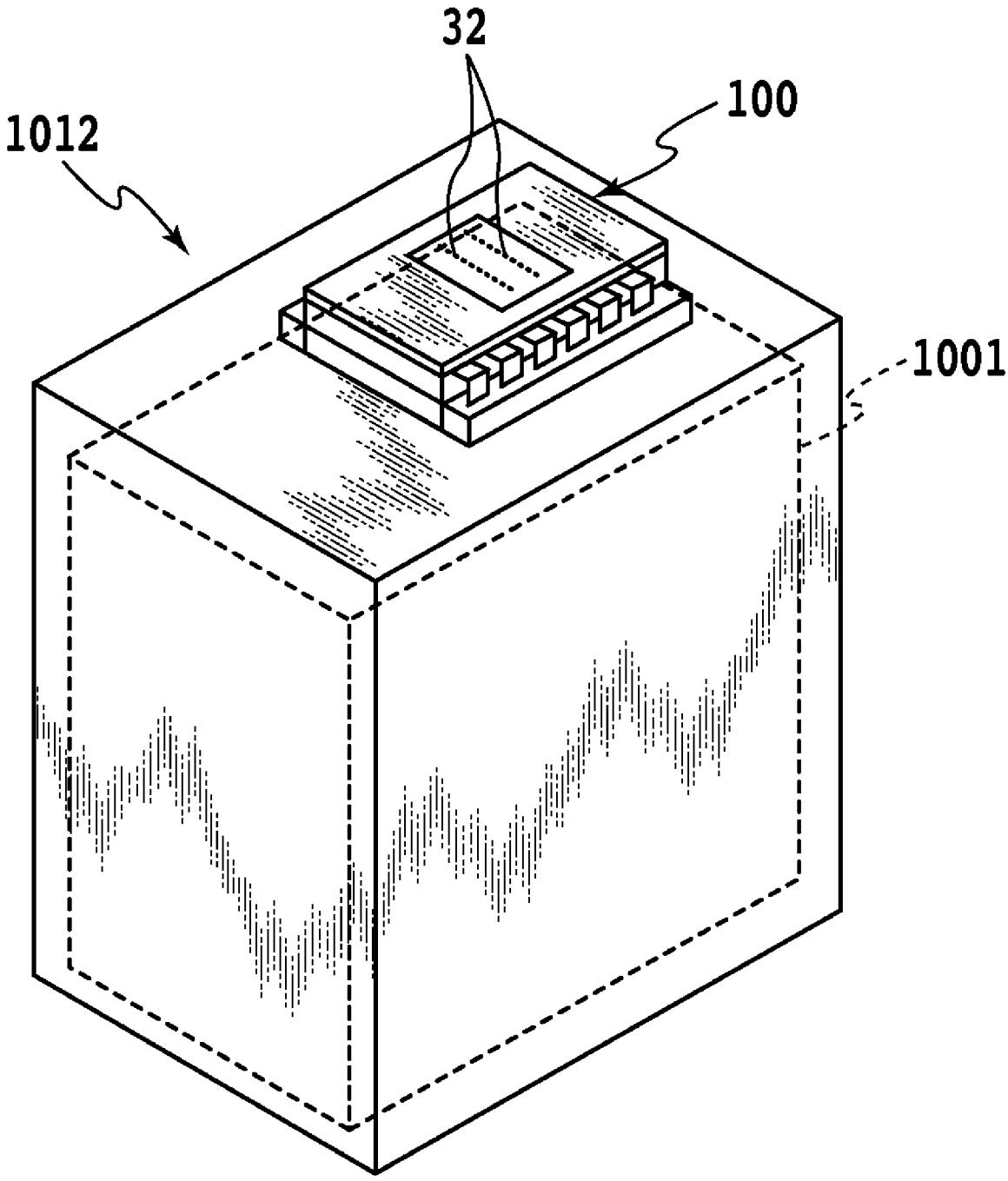
FIG. 15 is a diagram showing an example of a cartridge that can be mounted in an ink jet printing apparatus.

FIG. 15 shows an example of a cartridge that can be mounted in the above-described ink jet printing apparatus. The cartridge 1012 according to the present invention has a main part composed of an ink jet liquid ejecting head (hereinafter referred to as a liquid ejecting head) 100 and a liquid tank 1001 that accommodates a liquid such as ink. The liquid ejecting head 100 corresponds to embodiments described below and has an ejection opening column 32 with a large number of ejection openings formed therein and through which the liquid can be ejected. The liquid such as ink is guided from the liquid tank 1001 to a common liquid chamber in the liquid ejecting head 100 via a liquid supply passage (not shown). The cartridge 1012 according to the present embodiment is structured such that the liquid ejecting head 100 is integrated with the liquid tank 1001 and such that the liquid is fed to the interior of the liquid tank 1001 as required. As another means, a structure may be adopted in which the liquid tank 1001 is replaceably coupled to the liquid tank 1001.

Description will be given below of a specific example of the above-described liquid ejecting head 100, which can be mounted in the ink jet printing apparatus configured as described above.

Figure 16:
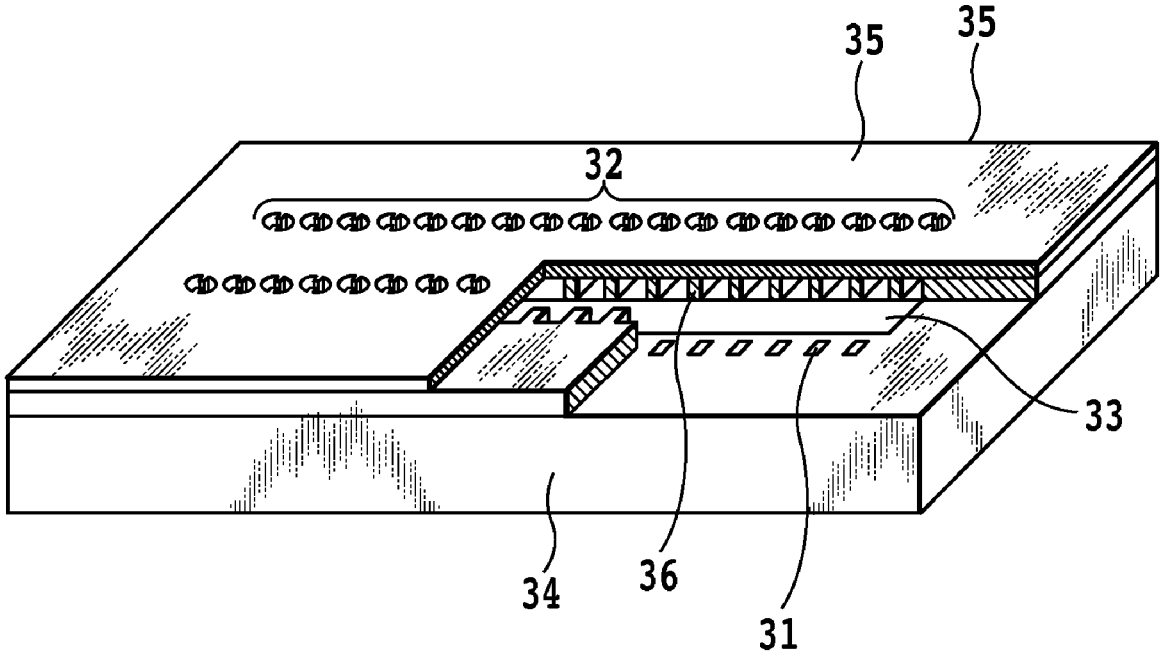
FIG. 16 is a schematic perspective view of a basic form of the present invention, schematically showing an essential part of a liquid ejecting head.

FIG. 16 is a schematic perspective view of parts of a liquid ejecting head embodying the present invention. Electric wiring and the like which are used to drive electrothermal converting elements are omitted from FIG. 16. In FIG. 16, a board 34 comprises electrothermal converting elements (hereinafter referred to as heaters) and a liquid supply port 33 made up of a groove-like through-port serving as a common liquid chamber portion. The heaters 31 (thermal energy generating means) are arranged in two lines on the respective sides of the liquid supply port 33 in a longitudinal direction at intervals of 600 dpi in a staggered manner. Liquid channel walls 36 are provided on the board 34 to form liquid channels. An ejection opening plate 35 comprising the ejection opening columns 32 is provided on the liquid channel walls 36.

Figure 1:
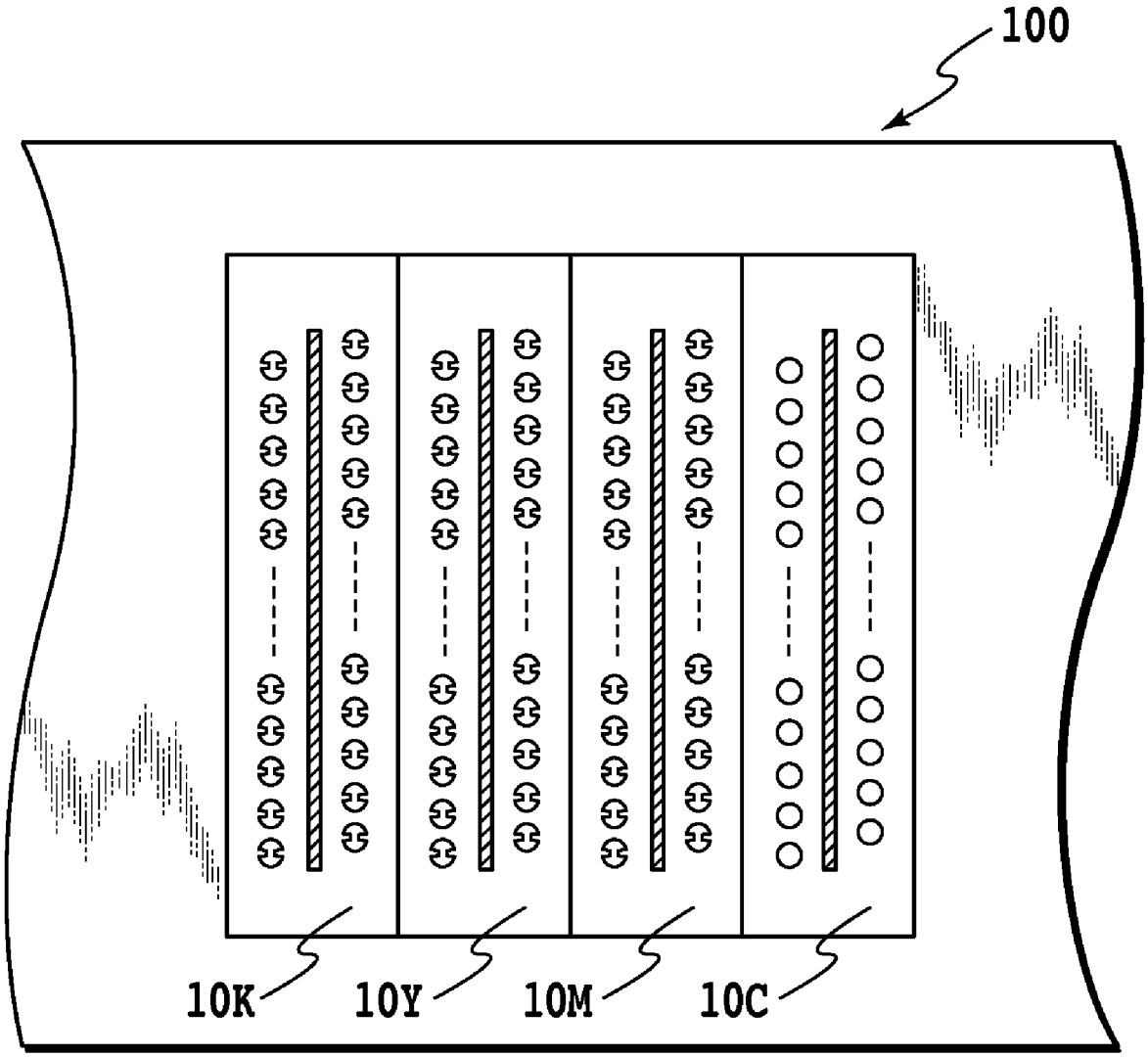
FIG. 1 is a schematic top view of a nozzle portion of a liquid ejecting head, showing a specific embodiment of the present invention.

FIG. 1 is a schematic top view of a nozzle portion of the liquid ejecting head 100, showing a specific embodiment of the present invention. The liquid ejecting head 100 comprises an ejection opening column 10C, an ejection opening column 10M, an ejection opening column 10Y, and an ejection opening column 10K which eject color inks in cyan, magenta, yellow, and black. Each of the ejection opening columns is composed of staggered ejection openings. In FIG. 1, only the ejection opening column 10C comprises circular ejection openings. The other ejection opening columns are composed of ejection openings with projections.

Thus, only one of the four types of ejection opening columns for the respective colors through which a particular one color ink (in the present embodiment, the cyan ink) is ejected is formed of circular ejection openings. That is, the characteristics of the cyan ink ejected through that ejection opening column are different from those of the other inks. That is, the cyan ink ejected through the circular ejection openings involves fewer satellites than the other types of ink during ejection. Furthermore, a specified time after the start of ejection, the cyan ink can be ejected less easily than the other liquids. In contrast, the inks (in the present embodiment, the magenta, yellow, and black inks) ejected through the ejection openings 37 with the projections involve the generation of relatively many satellites during ejection. The inks are also prevented from having difficulty being ejected through the ejection openings the specified time after the start of ejection. These inks are thus excellent.

Thus, for the ejection openings in the liquid ejecting head, either the shape with the projections or the circular shape is selected depending on the characteristics of the ink to be ejected. This allows the liquid having difficulty being ejected through the ejection openings the specified time after the start of ejection to be ejected through the circular ejection openings, offering a lower flow resistance. This prevents possible inappropriate ejection. The liquid involving the generation of relatively many satellites is ejected through the ejection openings with the projections. This makes it possible to inhibit the generation of satellites. This enables a reduction in the generation of mist from the liquid ejecting head as a whole. A reliable liquid ejecting head can thus be provided which is unlikely to be subjected to inappropriate ejection.

Figure 2A:
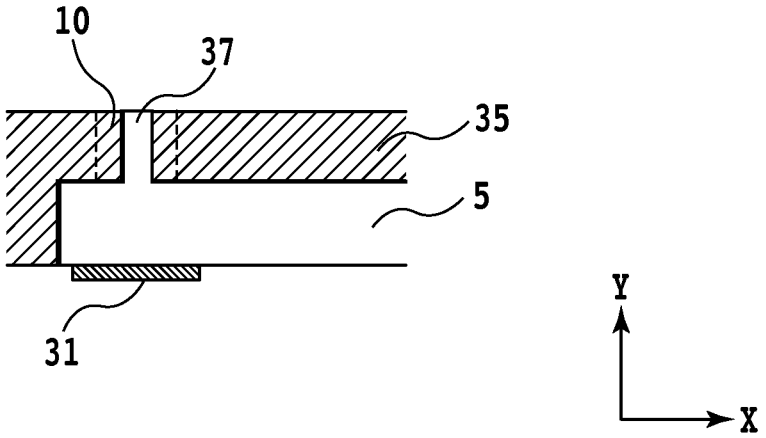
FIG. 2A is a diagram showing a cross section of a nozzle according to the present embodiment as viewed in an ejecting direction.
Figure 2B:
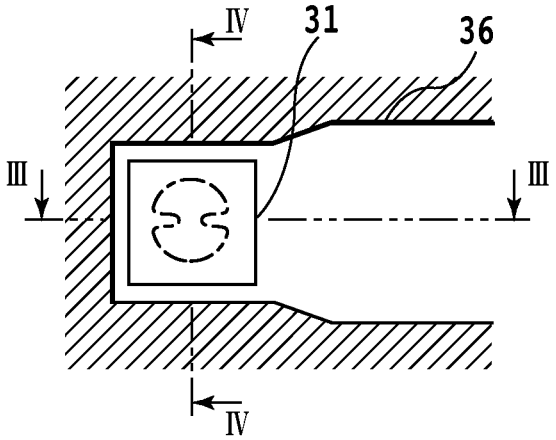
FIG. 2B is a front view of the nozzle according to the present embodiment.
Figure 2C:
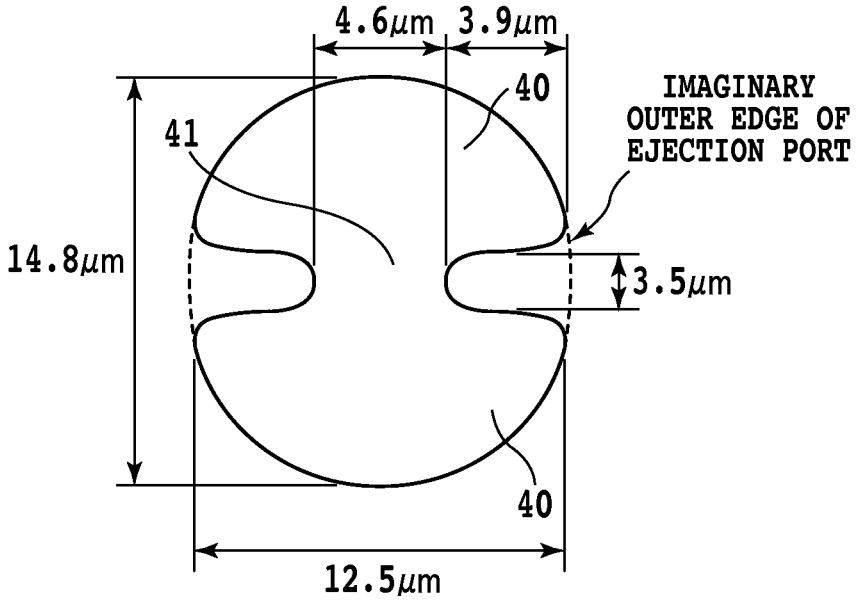
FIG. 2C is a diagram showing the shape of an ejection opening according to the present embodiment.

FIG. 2A is a diagram showing a cross section of the nozzle as viewed in an ejecting direction. The height of a liquid channel 5 is 16 μm, and the distance from the heater 31 to the surface of the ejection opening plate 35 is 26 μm. The ejection opening 37 has a pair of projections 10. FIG. 2B is a front view of the nozzle. The heater 31 has a size of 24.8 μm×24.4 μm. The ink channel wall 36 is provided to separate the adjacent nozzles from each other. FIG. 2C is a diagram showing the shape of the ejection opening 37. Each of the paired projections 10 provided on the ejection opening 37 has a width of 3.5 μm and a length of 3.9 μm. The gap between the projections is 4.6 μm. The projections 10 are provided perpendicularly to a scanning direction of the liquid ejecting head 100 and opposite each other. As shown in FIG. 2A, the ejection opening 37 is formed of a surface parallel to a droplet ejecting direction. Dashed lines in FIG. 2C show imaginary outer edges obtained if the ejection opening is circular. Thus, the ejection opening 37 in the present embodiment is shaped such that the projections are provided on the respective parts of the circular ejection part.

The present embodiment uses the ejection openings with the projections. The inventor's examinations indicate that varying the length of the projection extending from the imaginary outer edge toward the center of the ejection opening makes it possible to vary the balance between the capability of reducing mist and the easiness with which ejection can be performed a specified time after the start of ejection. Increasing the length of the projection from the ejection opening according to the present embodiment enables a reduction in the mist. However, this increases the peripheral length of the ejection opening, reducing the easiness with which ejection can be performed the specified time after the start of ejection. On the basis of this characteristic, each of the capabilities can be controlled on the basis of the length of the projection.

That is, with the normal circular ejection opening, when ejected, the liquid forms a tail portion (hereinafter also referred to as an ink tail) extending like a column. The ink tail is subsequently cut into droplets, which then reach a print medium. In this case, besides droplets (main droplets) that are essential to reach the print medium, secondary droplets called satellites are generated. In short, the process in which the satellites are generated can be expressed as "a liquid column of a certain length generated during ejection is separated into a plurality of fractions, which are rounded owing to surface tension". In general, the satellites are smaller and move slower than the main droplets. The satellites thus impact the print medium or another liquid receiver at positions located away from those of the main droplet. This degrades printing quality.

In contrast, droplets are ejected through the noncircular ejection openings 37, each having the projections 10 as described above. The ejection opening is thus shaped such that the ejection opening is separated into two ejecting portions 40 by the projections 10 and also has a further ejection portion 41 in the form of a slit between the projections 10. This makes it possible to control the amount of liquid ejected through the two portions 40 in the ejection opening 37 and the amount of liquid ejected through the slit portion 41.

For the liquid ejected through the ejection opening 37, a relatively large amount of liquid is ejected through the portions 40, arranged on the opposite sides of the ejection opening for main ejection. A relatively small amount of liquid is ejected through the slit portion 41, joining the openings 40 together.

Now, description will be given of the principle of ejection through the ejection opening with the projections according to the present invention. The method for ejection includes a bubble jet (BJ) ejecting scheme in which bubbles are not in communication with the air and a bubble through jet (BTJ) ejecting scheme in which the bubbles are in communication with the air. The present invention is applicable to both methods. The ejection principle will be described below taking each ejecting method by way of example.

(BJ Ejecting Scheme)

Figure 3:
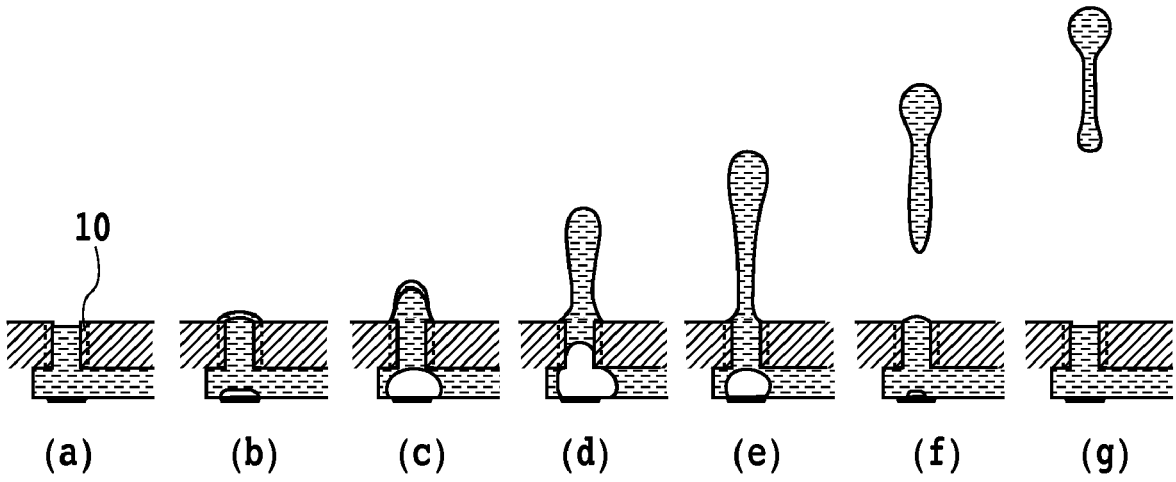
FIG. 3 is a diagram showing how a liquid is ejected from a cross section III-III in FIG. 2B.
Figure 4:
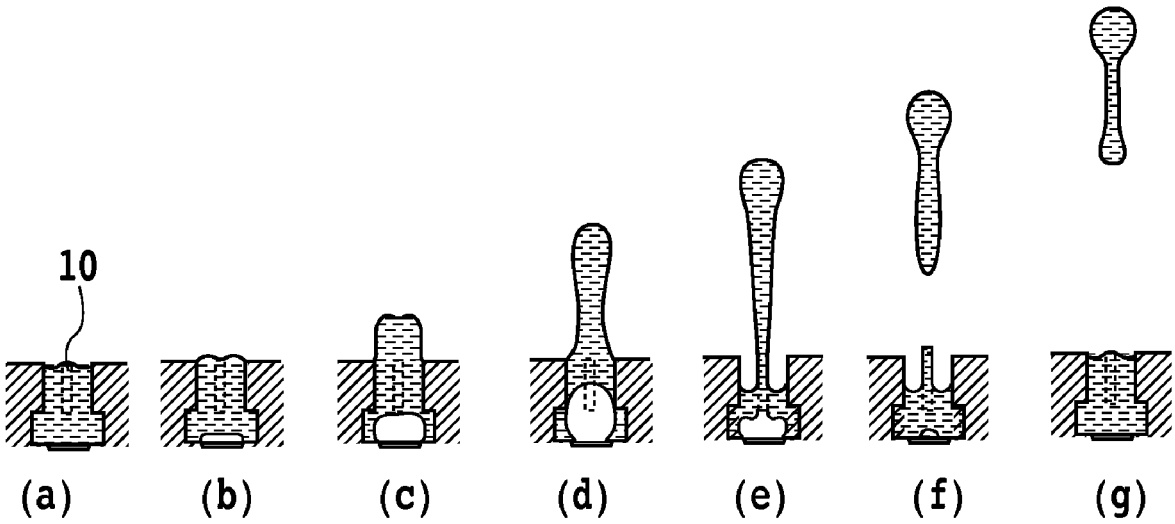
FIG. 4 is a diagram showing how a liquid is ejected from a cross section IV-IV in FIG. 2B.

FIGS. 3 and 4 are process drawings process of the bubble jet (BJ) ejecting scheme in which bubbles are not in communication with the air according to the present embodiment, showing ejecting steps for the respective ejection timings. The ejection timings (a) to (g) in FIG. 3 are sectional views of the head taken along line IV-IV in FIG. 2B. The ejection timings (a) to (g) in FIG. 4 are sectional views of the head taken along line III-III in FIG. 2B. The ejection timings (a) to (g) in FIG. 3 correspond to the ejection timings (a) to (g) in FIG. 4.

First, the process of bubble growth from the state at the ejection timing (a) in FIG. 3 to the ejection timing (d) in FIG. 3 corresponding to the maximum bubbling state is similar to that in the prior art. Thus, the description of this process is omitted. The bubble in the maximum bubbling state at the ejection timing (d) in FIG. 3 has grown into the ejection opening.

In the maximum bubbling state, a gas portion is at a pressure sufficiently lower than the atmospheric pressure. Thus, the volume of the bubble subsequently decreases to rapidly take the surrounding liquid into the place in which the bubble was present. This flow of the liquid returns the liquid toward the heater inside the ejection opening. However, since the ejection opening is shaped as shown in FIG. 2C, the liquid is positively drawn in through the parts of the ejection opening which have no projection and which correspond to low fluid resistance portions. At this time, a liquid surface formed in the low fluid resistance portion between an inner side surface thereof and the columnar liquid sinks in significantly toward the heating element so as to form a recess. On the other hand, at this time, the liquid attempts to stay in the part between the projections, which constitutes a high fluid resistance portion. Thus, as shown at the ejection timing (e) in FIG. 3, the liquid in the ejection opening in the vicinity of an end of the opening in the ejection opening remains so that the liquid surface (liquid film) is spread only in the area between the projections, which corresponds to the high fluid resistance portion. That is, while the liquid surface joining to the columnar liquid extending to the outside of the ejection opening is held by the high fluid resistance area (first area), the liquid in the ejection opening is drawn toward the heater by the plurality of low fluid resistance areas (second areas). Thus, the liquid surface sinking in significantly to form a recess is formed in the plurality of (in the present embodiment, two) low fluid resistance portions of the ejection opening. The state of the liquid (liquid column) observed at this time is three-dimensionally shown in FIGS. 5A, 5B, and 5C.

In this case, the amount of liquid remaining in the area between the projections, which corresponds to the high fluid resistance portion, is smaller than the amount of liquid defined by the diameter of the liquid column. Consequently, the projections make the liquid column partly thin to form "constricted portions".

Figure 5A:
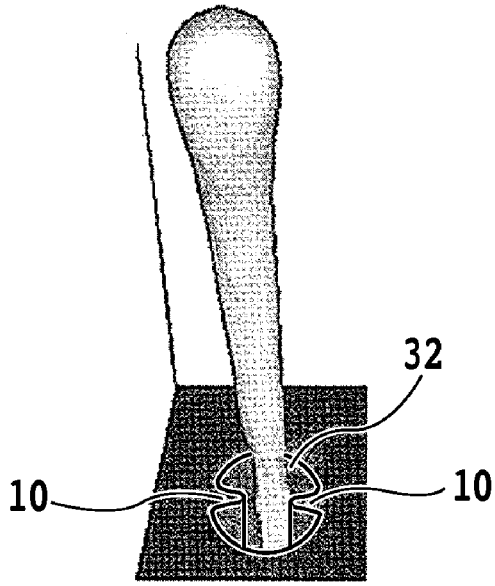
FIG. 5A is a perspective view of a simulation, showing the state of a liquid column as viewed from a direction perpendicular to projections.
Figure 5B:
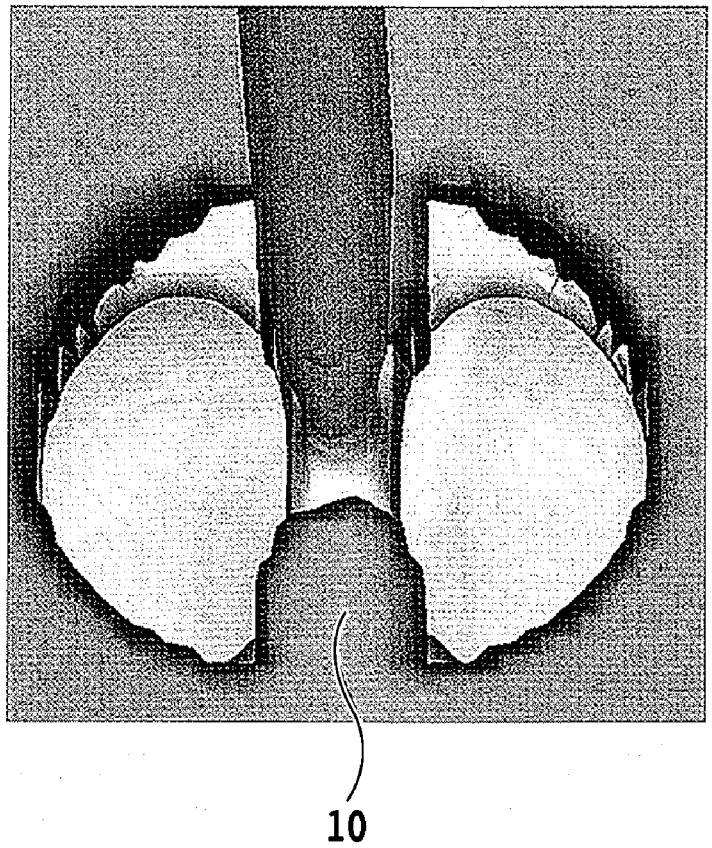
FIG. 5B is an enlarged perspective view of the simulation, showing a constricted portion of the liquid column as viewed from the direction of the projections.
Figure 5C:
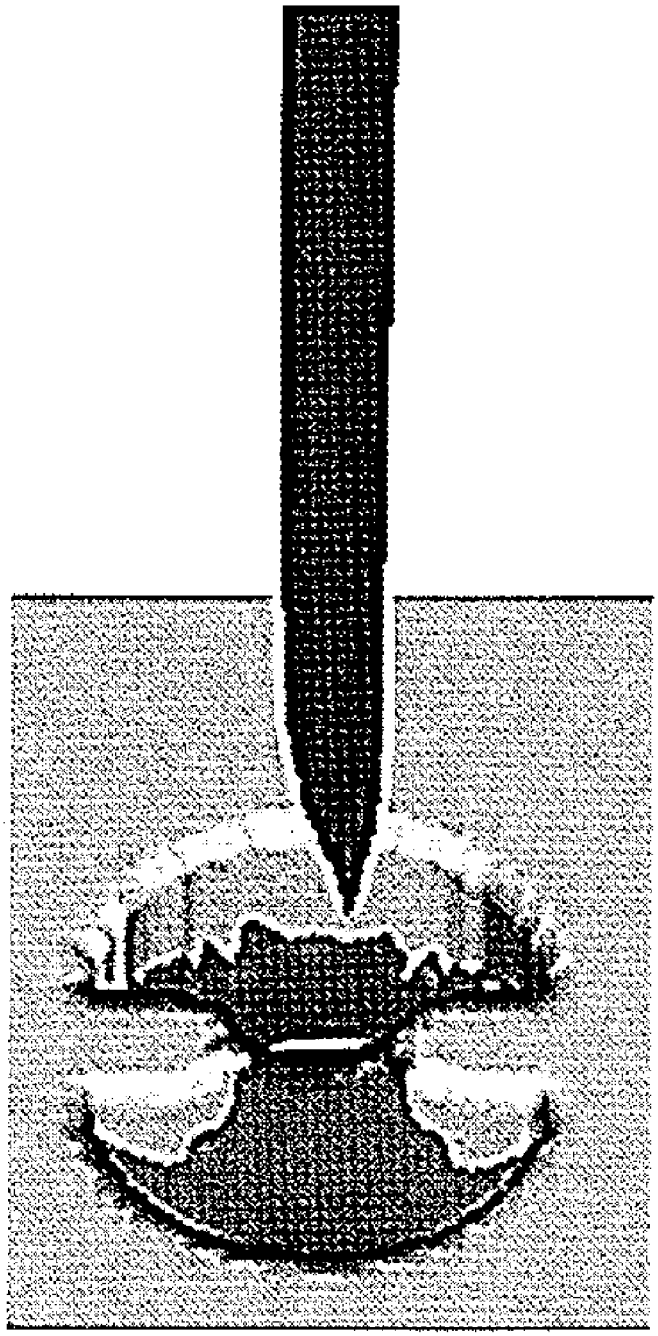
FIG. 5C is an enlarged diagram showing an ejection opening in FIG. 5A.

FIG. 5A is a perspective view of a simulation, showing the state of the liquid column as viewed from a direction perpendicular to the projections. FIG. 5B is an enlarged perspective view of the simulation, showing the "constricted portions" of the liquid column as viewed from the direction of the projections. The "constricted portions" formed over the projecting portions and at the root of the liquid column are seen from different directions in FIGS. 5A and 5B. FIG. 5C is an enlarged view of the opening in FIG. 5A.

Subsequently, while the liquid surface (liquid film) joining to the liquid column extending to the outside of the ejection opening is held in the high fluid resistance area, the liquid column extending to the outside of the ejection opening is separated into fractions at the constricted portions of the liquid column formed in the high fluid resistance area over the projections (FIG. 5C). The ejected liquid is separated into fractions at this timing, and the separation occurs earlier than that in the prior art by at least 1 to 2 μsec. That is, if the rate at which droplets are ejected is 15 m/sec., the trail decreases by at least 15 to 30 μm. At this time, almost no force drawing the liquid toward the heater in association with the debubbling is exerted on the liquid between the projections. This prevents a force from acting in a direction opposite to that of a speed vector with which the ejected liquid is to flow as in the prior art. The speed of the trailing end of each of the droplets is sufficiently high compared to that in the prior art. This prevents a possible phenomenon such that the part of the ejected liquid which is shaped like a liquid column is spread and elongated. As a result, the ejected liquid is smoothly separated into fractions, excellently inhibiting the generation of mist; a large amount of mist is conventionally generated when the ejected liquid (liquid column) is separated into fractions.

Subsequently, the trailing portion of each of the flying droplets becomes spherical owing to surface tension. The droplets are soon separated into main droplets and sub-droplets (satellites). If the difference between the speed of the droplet trailing end and the speed of the droplet leading end is sufficiently small, the satellites resulting from the separation unite with one another during flying or on a sheet. This substantially prevents the possible adverse effects of satellites.

Figure 6:
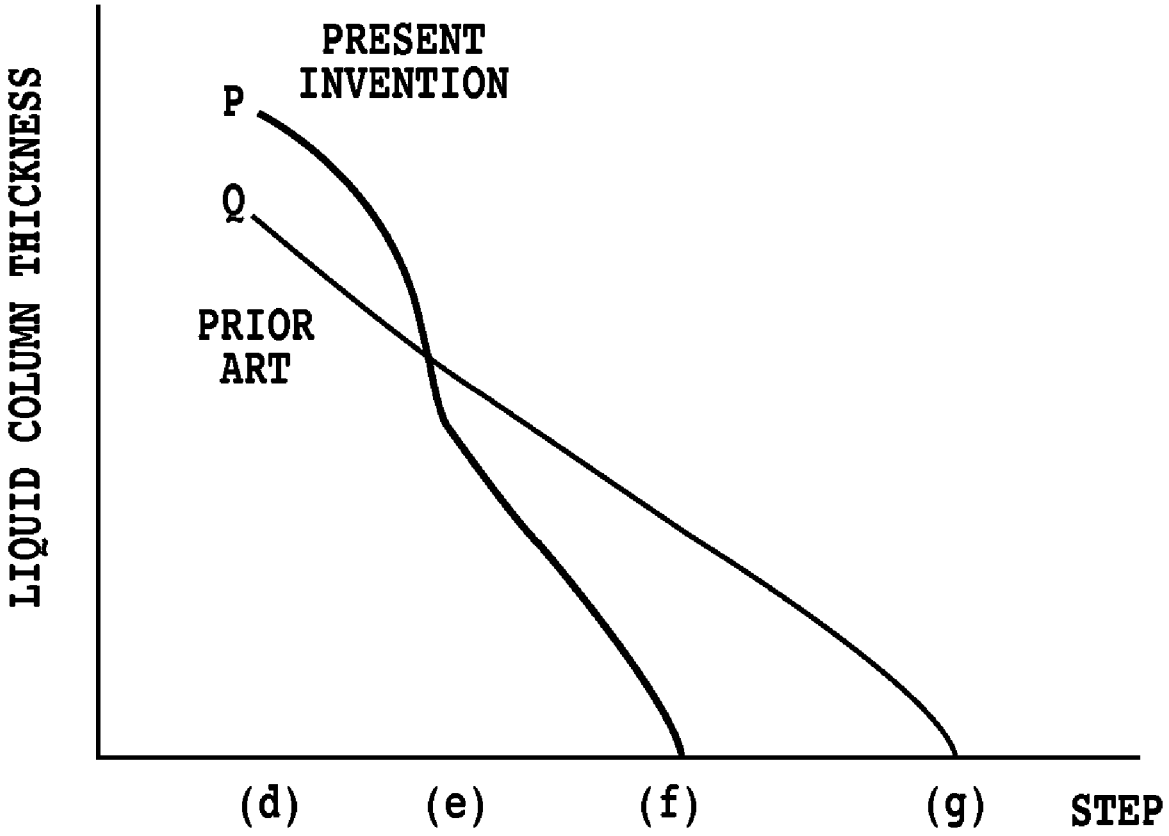
FIG. 6 is a graph showing the relationship between the thickness of a liquid column during ejection and ejecting steps according to the present embodiment.

FIG. 6 is a graph showing the variation in the thickness of the liquid column during ejection over the course of the ejecting steps according to the present embodiment. In FIG. 6 a line P indicates the present embodiment, and a line Q indicates the prior art which use circular opening. In FIG. 6, the thickness means the minimum diameter of the liquid column thickness and the ejecting steps. The term "minimum diameter of the liquid column diameter" refers to the diameter of a part of the liquid column sticking out from the ejection opening which has the smallest cross section in the whole liquid column except for the spherical portion constituting the main droplet. (d) to (g) on the axis of abscissa correspond to the steps in FIG. 3.

In FIG. 6, the initial thickness of the liquid column varies between the present invention and the prior art because the shape of the ejection opening in the present embodiment is such that a conventional circular ejection opening is divided into two half circles with a projection interposed between the half circles, increasing the maximum diameter compared to the conventional ejection opening. In the conventional configuration, as shown in FIG. 6, the minimum diameter of the liquid column thickness decreases at an almost fixed rate over time. In contrast, in the configuration according to the present embodiment, the thickness of the liquid column during the debubbling step varies rapidly. This is expected to be because meniscus is partly drawn in in association with debubbling to sharply reduce the amount of liquid contacting the liquid column held by the projections, forming a constricted portion at the root of the liquid column as previously described. Consequently, in step (e), the liquid column becomes very thin, and the ejected liquid is separated into fractions earlier than that in the prior art.

(BTJ Ejecting Scheme)

Figure 7:
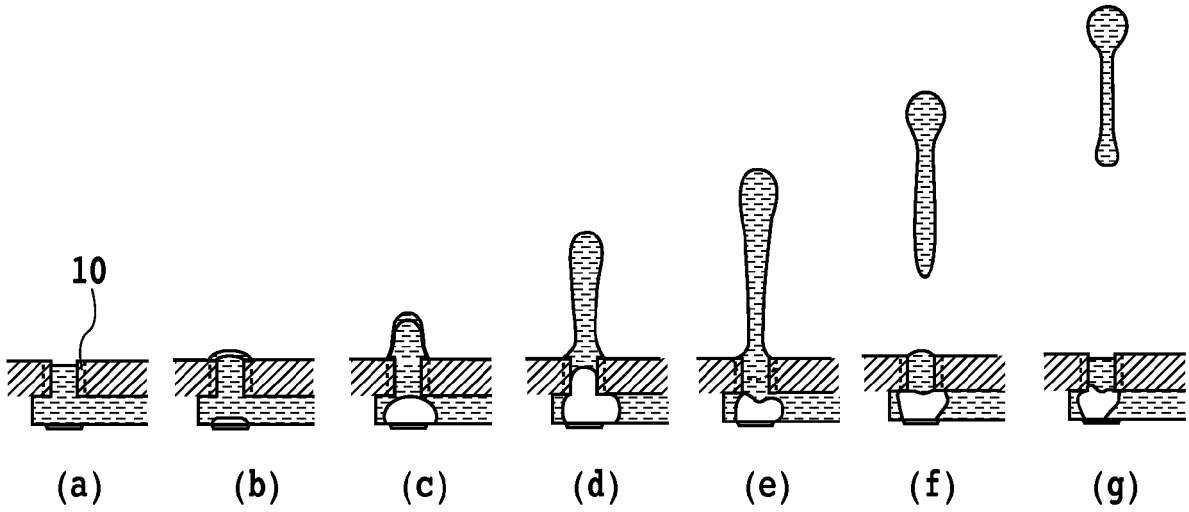
FIG. 7 is a process drawing of a bubble through jet ejecting scheme in which bubbles are in communication with the air, showing ejecting steps for the respective ejection timings.

FIG. 7 is a process drawing of BTJ (bubble through jet) ejecting scheme in which bubbles are in communication with the air, showing ejecting steps for the respective ejection timings. Ejection timings (a) to (g) in FIG. 7 correspond to ejection timings (a) to (g) in FIG. 8. A condition for BTJ is such that the distance OH from the heater to the ejection opening is set shorter (to 20 to 30 μm) than that in the example of BJ (FIG. 2A). Thus, the bubble grows upward (in the direction of the ejection opening) (FIG. 7(*d*)) to draw the meniscus further into the ejection opening. The meniscus thus communicates with the bubbles in the nozzle (FIG. 7(*f*)). Thus, the meniscus is readily drawn in through the low fluid resistance area. The liquid film is spread between the projections at an early timing, allowing the separation of the droplet to occur earlier.

Figure 8:
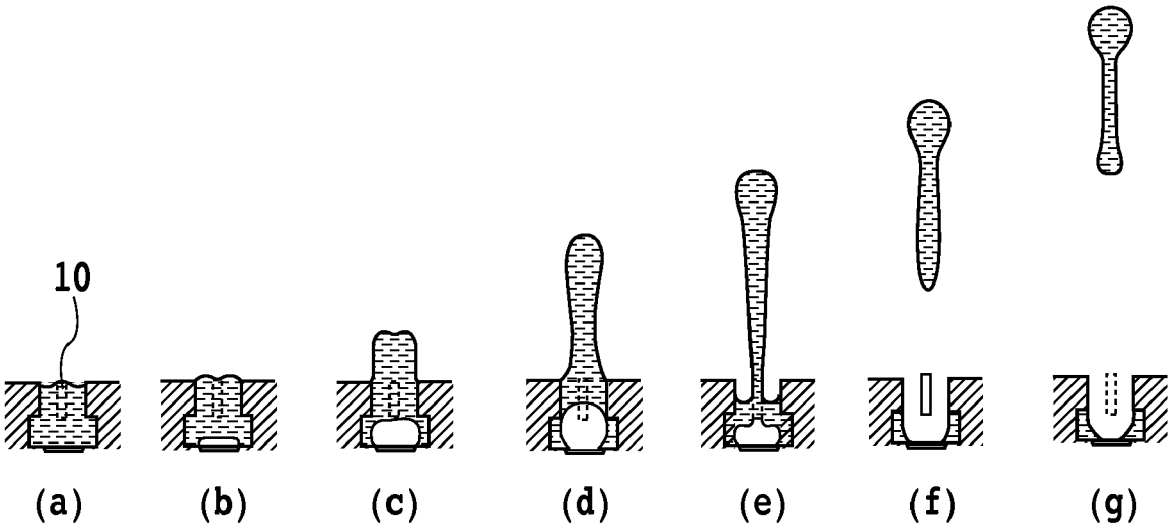
FIG. 8 is a process drawing of the bubble through jet ejecting scheme in which bubbles are in communication with the air, showing ejecting steps for the respective ejection timings.

Furthermore, with the conventional ejection opening without any projection, the trailing end of the ejected droplet is bent. The satellite thus flies away from the track of the main droplet. However, the projections according to the present embodiment exert not only the effect of allowing the separation of the ejected droplet to occur earlier than with the conventional BTJ to reduce the trailing but also the effect of inhibiting the trailing from being bent during the separation. This is because as shown in FIGS. 7 and 8, the separation of the droplet always occur between the projections and thus in the center of the ejection opening. This in turn maintains the linearity of the tracks during flying, inhibiting the possible generation of satellites and the possible degradation of images.

(Shape of the Projection)

Preferable shapes of the projection for embodiments of the present invention will be described in further detail. The term "shape of the projection" refers to the shape of the projection observed when the ejection opening is viewed from the liquid ejecting direction, that is, the sectional shape of the ejection opening in the liquid ejecting direction.

Figure 9:
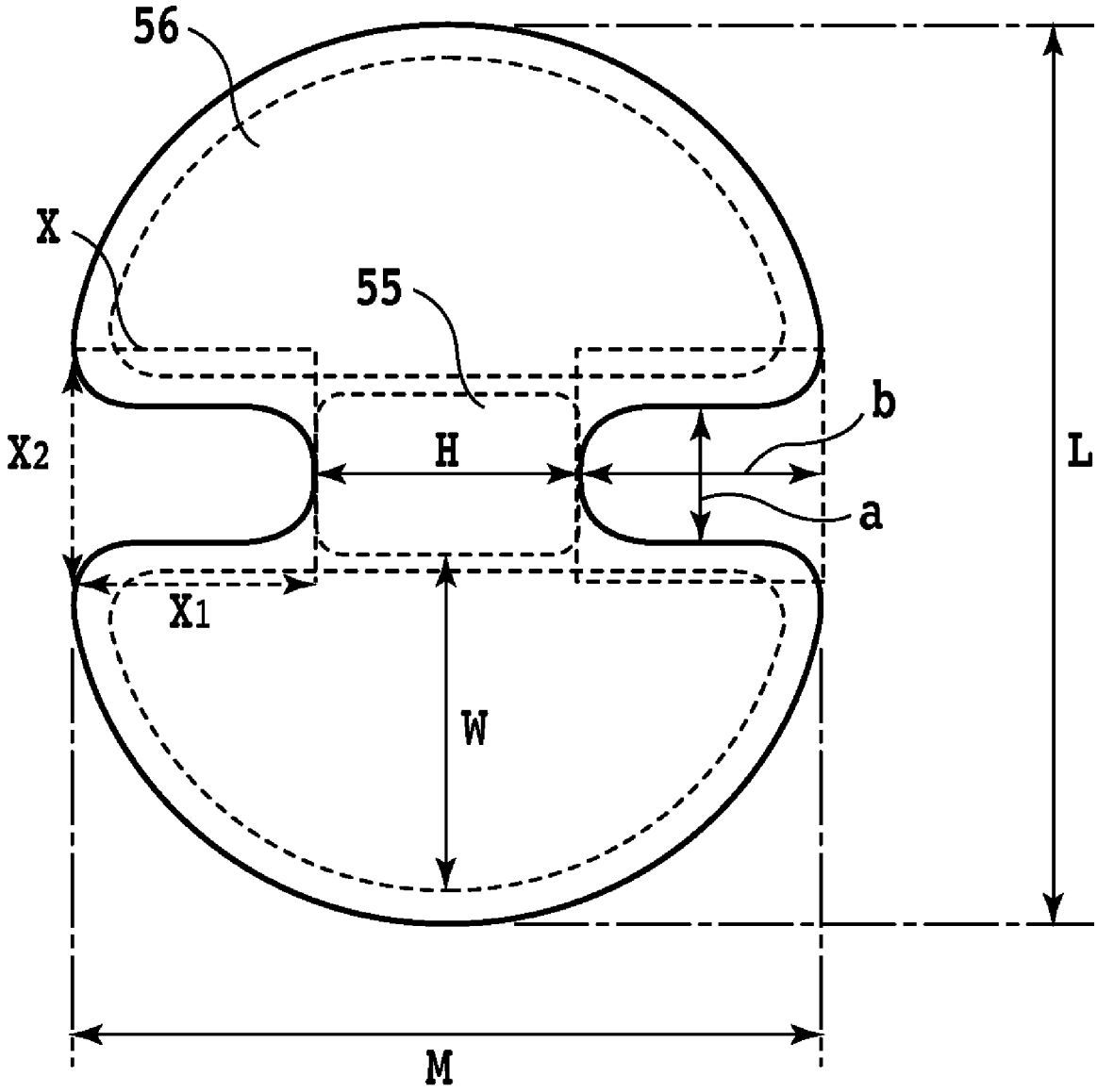
FIG. 9 is a diagram showing the shape of an ejection opening according to the present embodiment.

FIG. 9 shows the shape of the ejection opening according to the present embodiment. To appropriately form a high fluid resistance area 55 and a low fluid resistance area 56, it is desirable to set the length W of the low fluid resistance area 56 longer than the shortest distance (the gap between the projections) H defined by the projections.

In FIG. 9 the number of projections is two and the width of each of the projections is almost uniform except for a part thereof having the curvature of the leading end and the part of the root. Let M be the minimum diameter of the ejection opening at the imaginary outer edge of the ejection opening measured when no projection is provided (according to the present embodiment, with the two projections, the distance from the root of the projection to the root of the opposite projection, and with the signal projection, the distance from the root of the projection to the corresponding edge). Let a and b be the width and length respectively of the projection. When the formula:

$$M \geqq (L-a)/2 > H$$

is met, the balance between the half circle portion and the projections in the ejection opening is preferable for implementing the ejecting method according to the present invention. More preferably, the formula:

$$M \geqq (L-a)$$

is met. Furthermore, the inter-projection gap H is greater than 0, and holding the liquid film between the projections allows the ejecting scheme according to the present embodiment to be established.

Reference character X in FIG. 9 denotes a projection area. The projection area X is made up of a rectangle having, as two sides, the length of the projection (X1: the length from the root to leading end of the projection) in the direction in which the projection extends inward of the ejection opening (the direction in which the projection projects) and the width of the root of the projection in the width direction of the projection (X2: the linear distance from one bending point on the root of the projection to the opposite bending point on the root). If no definite bending point for X2 is present, tangent points obtained by drawing a tangent line at the root of the projection on the outer periphery of the ejection opening are considered to be bending points. According to the present embodiment, when each of the projections satisfies the relation:

$$0 < X2/X1 \leqq 1.6,$$

the force holding the liquid film between the projections is increased. This enables the meniscus between the projections to be preferably maintained until the moment when the droplet is separated. The trailing length can thus be reduced. Furthermore, when the projection satisfies the relation:

$$M \geqq (L-X2)/2 > H,$$

the balance between the half circle portion and the projections in the ejection opening is preferable for implementing the ejecting method according to the present invention.

In an embodiment of the present invention, the liquid film is formed and held between the projections. Thus, the liquid column formed is cut early on an ejection opening front surface side of the liquid film and then ejected as a droplet. This shortens the trailing of the ejected droplet. That is, it is important that the liquid film be held until the moment when the droplet is separated into fractions. The leading end of the projection is preferably shaped so as to easily hold the liquid film formed between the projections (easily maintain the surface tension).

Figure 10:
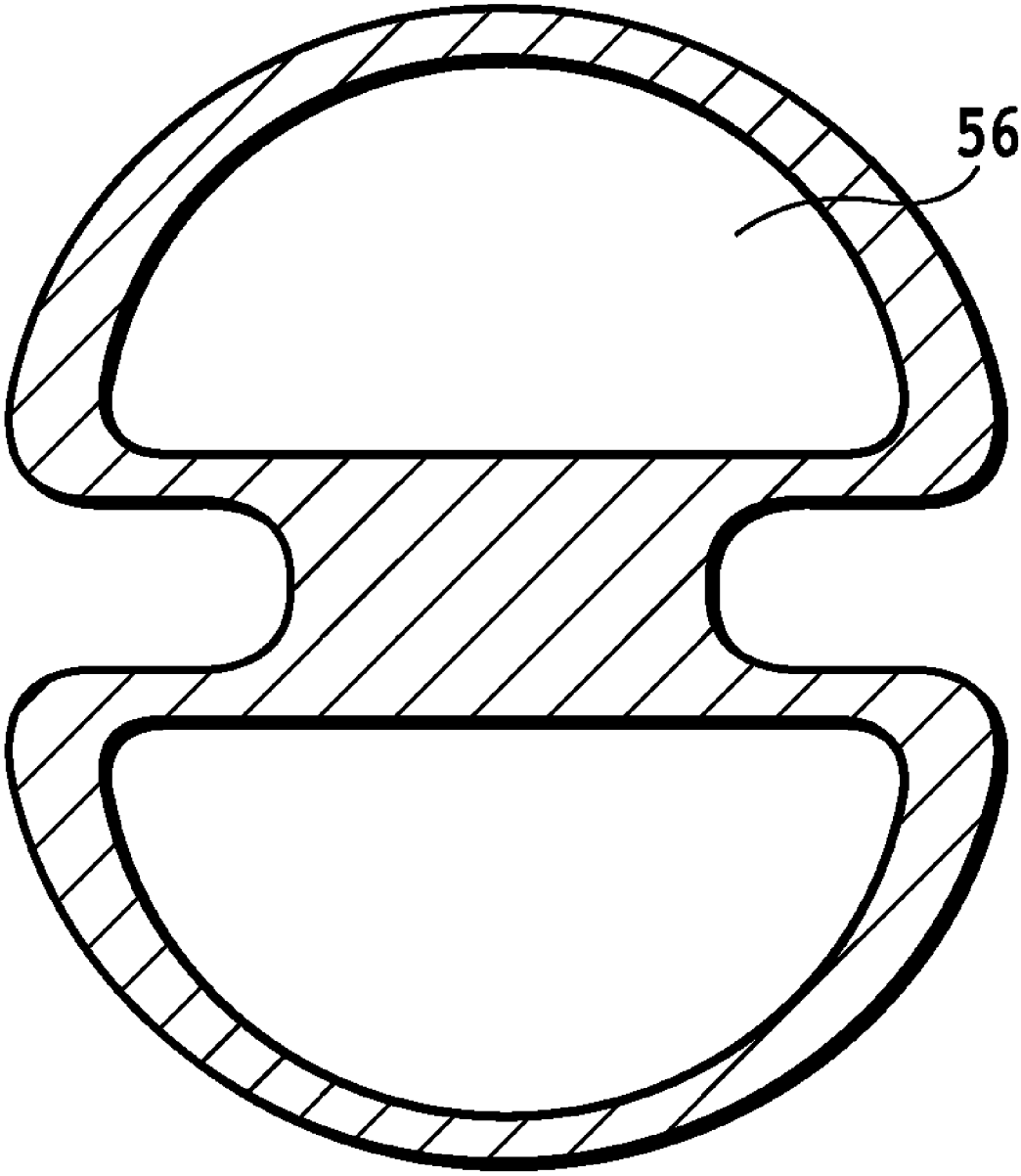
FIG. 10 is a schematic diagram illustrating how a liquid moves in the ejection opening during a bubble shrinking step according to the present embodiment.

FIG. 10 is a schematic diagram illustrating how the liquid in ejection opening moves during a bubble shrinking step. In the ejection opening according to the present embodiment, during the bubble shrinking step, a sinking force, tending to cause the meniscus to sink toward the heater such that the meniscus is shaped like a half circle, is exerted as shown in the low fluid resistance area 56, shown in FIG. 10. This allows the liquid film between the projections to be held as shown by the shading in FIG. 10. When the projection has linear portions on the respective sides thereof which are parallel to each other, the meniscus in the low fluid resistance portion 56 sinks in readily so as to be shaped like a half circle. Furthermore, in the example in the present embodiment, the leading end of the projection has a curvature. However, the present embodiment is effective even when the leading end of the projection is shaped to have a linear portion perpendicular to the direction in which the projection projects, for example, when the leading end of the projection is rectangular.

The shapes of the projection and the ejection opening described above serve to exert a strong force holding the liquid film between the projections as shown in the simulation in FIGS. 5B and 5C. The liquid film is held between the projections even during the formation of the liquid column as shown in FIG. 5B or even after the liquid column is separated from the liquid film and flies away as shown in FIG. 5C. Thus, the liquid column is separated from the liquid film near the surface of the ejection opening. This enables a reduction in the trailing length of the ejected droplet and thus in the generation of satellites.

Moreover, as shown in the sectional view in FIG. 2A, it is preferable in connection with the symmetry of the position of the meniscus and the stability of ejection that the central axis of the ejection opening in the liquid ejecting direction be perpendicular to the ejection opening surface and the energy generating element. If the central axis of the ejection opening portion is not perpendicular to the ejection opening surface or the heating elements, when the position of the meniscus moves toward the heating elements in the ejection opening portion during the bubble shrinking stage, the meniscus position exhibits a significant asymmetry. This may prevent the full advantageous effects of the present invention from being achieved.

In the present embodiment, two main ejection portions 40 are present in the ejection opening. However, the present invention is not limited to this. Projections may be provided so as to form three or four main ejection portions in an opening.

The cyan ink used in the present embodiment has physical property values including a viscosity of 2.4 cps and a surface tension of 33 dyn/cm.

Printing with improved image quality and reliability has been successfully achieved by thus using the liquid ejecting head comprising the plural types of ejection openings, the circular ejection openings and the noncircular ejection openings.

Second Embodiment

A second embodiment of the present embodiment will be described with reference to the drawings.

A liquid ejecting head 200 according to the present embodiment has circular ejection openings and ejection openings with projections as is the case with the first embodiment. However, the ejection openings with the projections include two types of ejection openings, those having longer projections and those having shorter projections. That is, the liquid ejecting head 200 according to the present embodiment is composed of a total of three different types of ejection openings. Otherwise the configuration of the liquid ejecting head 200 according to the present embodiment is similar to that of the liquid ejecting head shown in the first embodiment.

Figure 11:
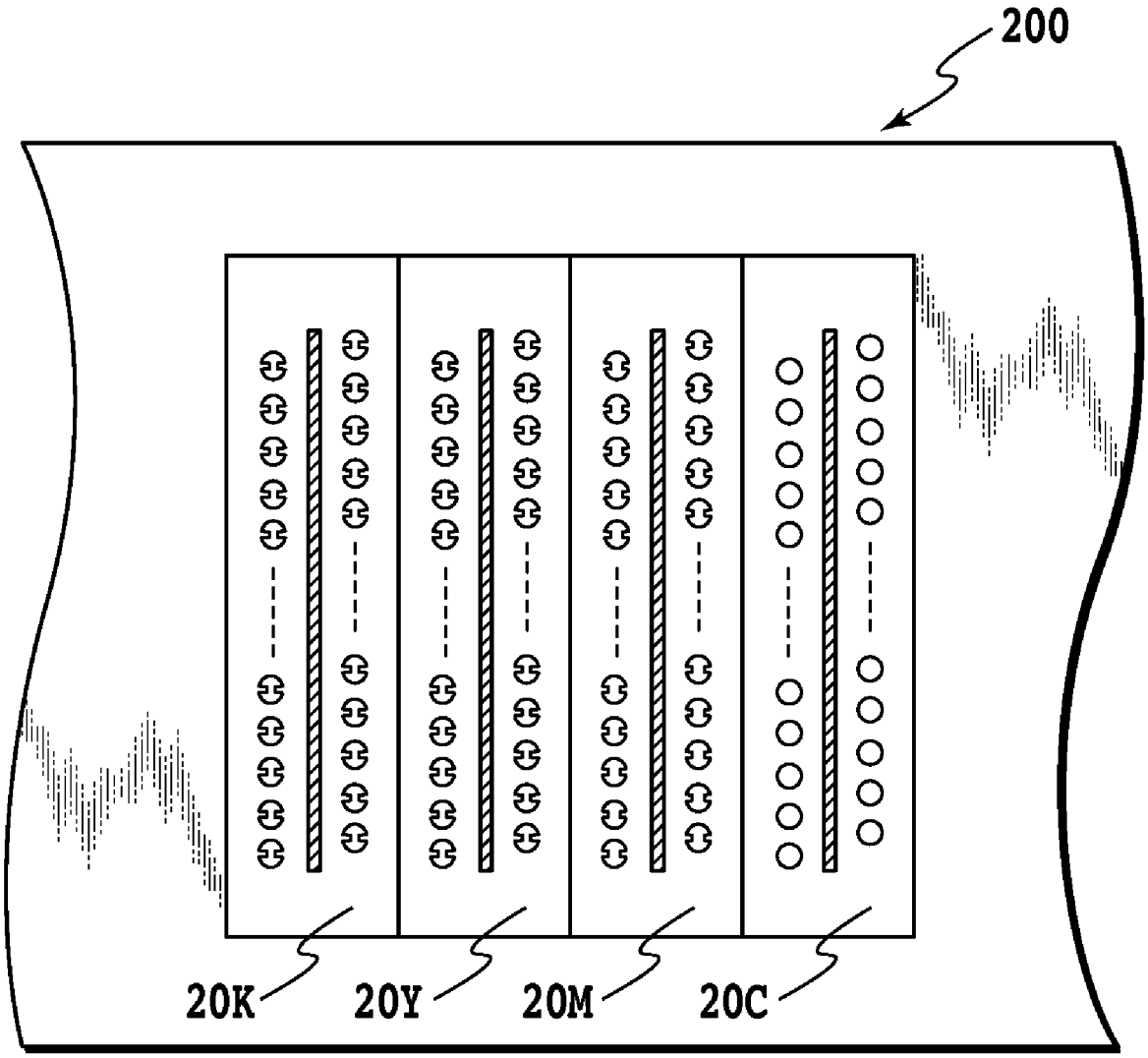
FIG. 11 is a schematic top view of a nozzle portion of a liquid ejecting head according to a second embodiment.

FIG. 11 is a schematic top view of a nozzle portion of the liquid ejecting head 200 according to the present embodiment. An ejection opening column 20C comprises circular ejection openings. An ejection opening column 20M comprises ejection openings with shorter projections. Ejection opening column 20Y and 20K comprise longer projections. The ejection openings with the longer projections are similar to the nozzle shown in FIG. 2C.

Figure 12A:
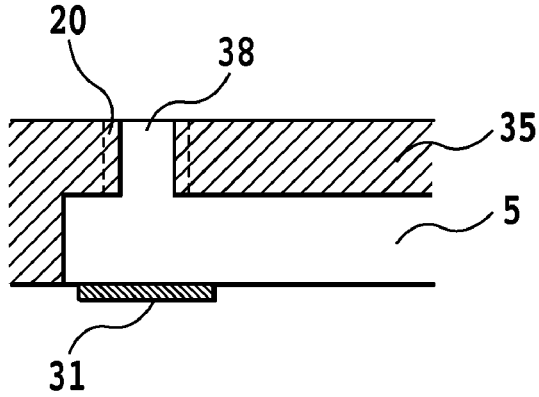
FIG. 12A is a diagram showing a cross section of a nozzle according to the second embodiment as viewed in the ejecting direction.
Figure 12B:
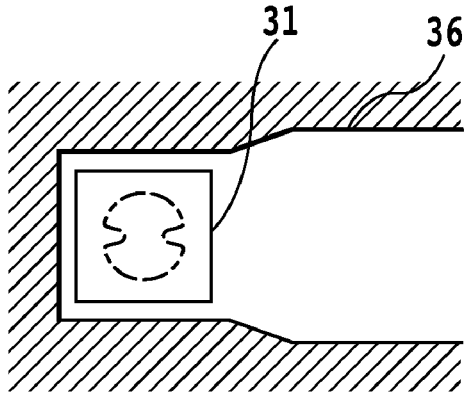
FIG. 12B is a front view of the nozzle according to the second embodiment.
Figure 12C:
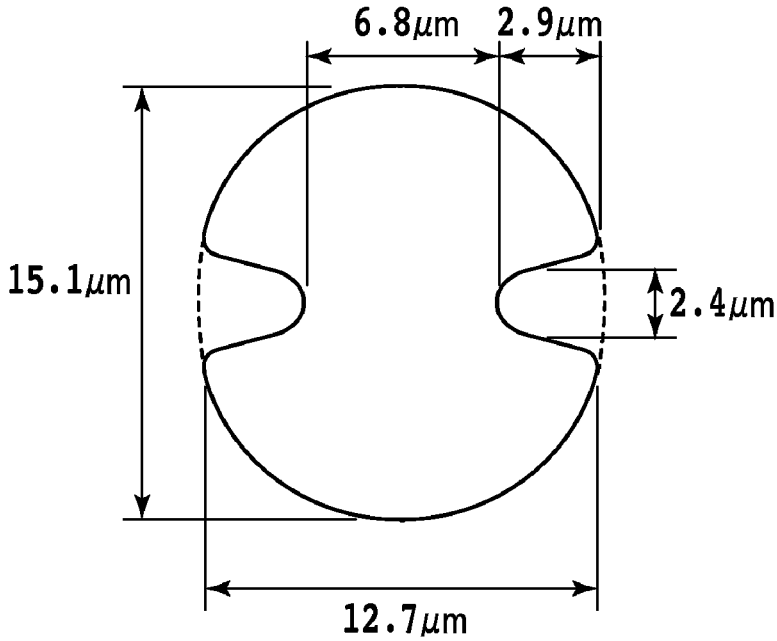
FIG. 12C is a diagram showing the shape of an ejection opening according to the second embodiment.

FIG. 12A is a diagram showing a cross section of the nozzle as viewed in the ejecting direction. The configuration of the nozzle is similar to that in the first embodiment except for projections 20. FIG. 12B is a front view of the nozzle. The size of the heater 31 is also similar to that in the first embodiment. FIG. 12C shows the shape of an ejection opening 38. The paired projections 20 provided on the ejection opening 38 each have a width of 2.4 μm and a length of 2.9 μm. The gap between the projections is 6.8 μm. The projection 20 is thus shorter than the projection on each of the ejection openings in the ejection rows 10Y and 10K. Consequently, each of the ejection openings in the ejection opening column 20M has a shorter peripheral length. The flow resistance during ejection is lower in the ejection openings in the ejection opening column 20M than in the ejection openings in the ejection opening column 20Y and 20K.

TABLE 1

| Projection length | Printing halt time | | |
|---|---|---|---|
| [um] | 0.9 | 1.8 | 2.7 |
| 2.9 | s | s | s |
| | ○ | ○ | ○ |
| 3.3 | ○ | ○ | x |
| 3.9 | ○ | x | x |

Table 1 shows measurement results showing whether or not ejection is normal when printing is performed again after a predetermined printing halt time. This table indicates that the longer projection is likely to cause inappropriate ejection when a longer time is required for sheet feeding. This measurement used the magenta ink.

Thus, one of the plural types of the ejection openings in the liquid ejecting head is a circular type, and the other ejection openings have one of the two types of projections with different lengths. This makes it possible to more precisely adjust the easiness with which ejection is performed a specified time after the start of ejection, in accordance with the characteristic of the liquid to be ejected. This enables a reduction in the amount of mist generated. As a result, printing can be achieved using a wide range of liquids. A liquid ejecting head can thus be provided which enables printing with improved image quality and reliability.

Third Embodiment

A third embodiment of the present invention will be described below with reference to the drawings.

Figure 13:
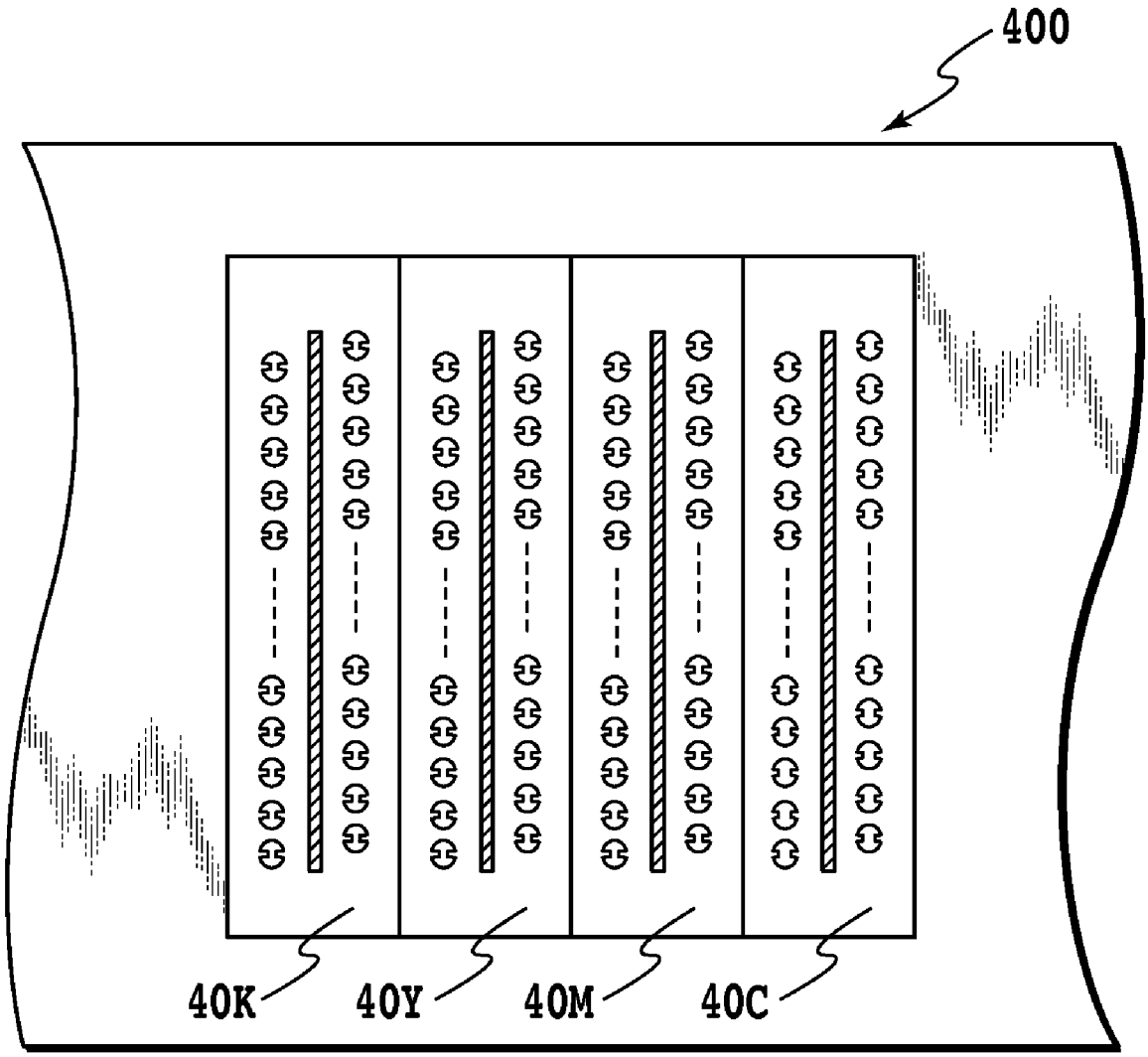
FIG. 13 is a schematic top view of a nozzle portion of a liquid ejecting head according to a third embodiment.

FIG. 13 is a schematic top view of a nozzle portion of a liquid ejecting head 400 according to the present embodiment. The liquid ejecting head 400 according to the present embodiment is composed of an ejection opening column 40C comprising ejection openings with shorter projections and ejection opening columns 40K, 40Y, and 40M comprising ejection openings with longer projections. The remaining part of the basic configuration is similar to those of the first and second embodiments. The ejection openings with the shorter projections are similar to those shown in FIG. 12C. The ejection openings with the longer projections are similar to those shown in FIG. 2C. The liquid ejecting head configured as described above is suitable for printing with a liquid that can be relatively easily ejected a specified time after the start of ejection.

Thus, depending on the liquid for printing, even the liquid ejecting head composed only of the noncircular ejection openings enables a reduction in the amount of mist generated. A liquid ejecting head has thus been successfully provided which makes it possible to inhibit inappropriate ejection and to achieve printing with improved image quality and reliability.

Fourth Embodiment

Figure 14:
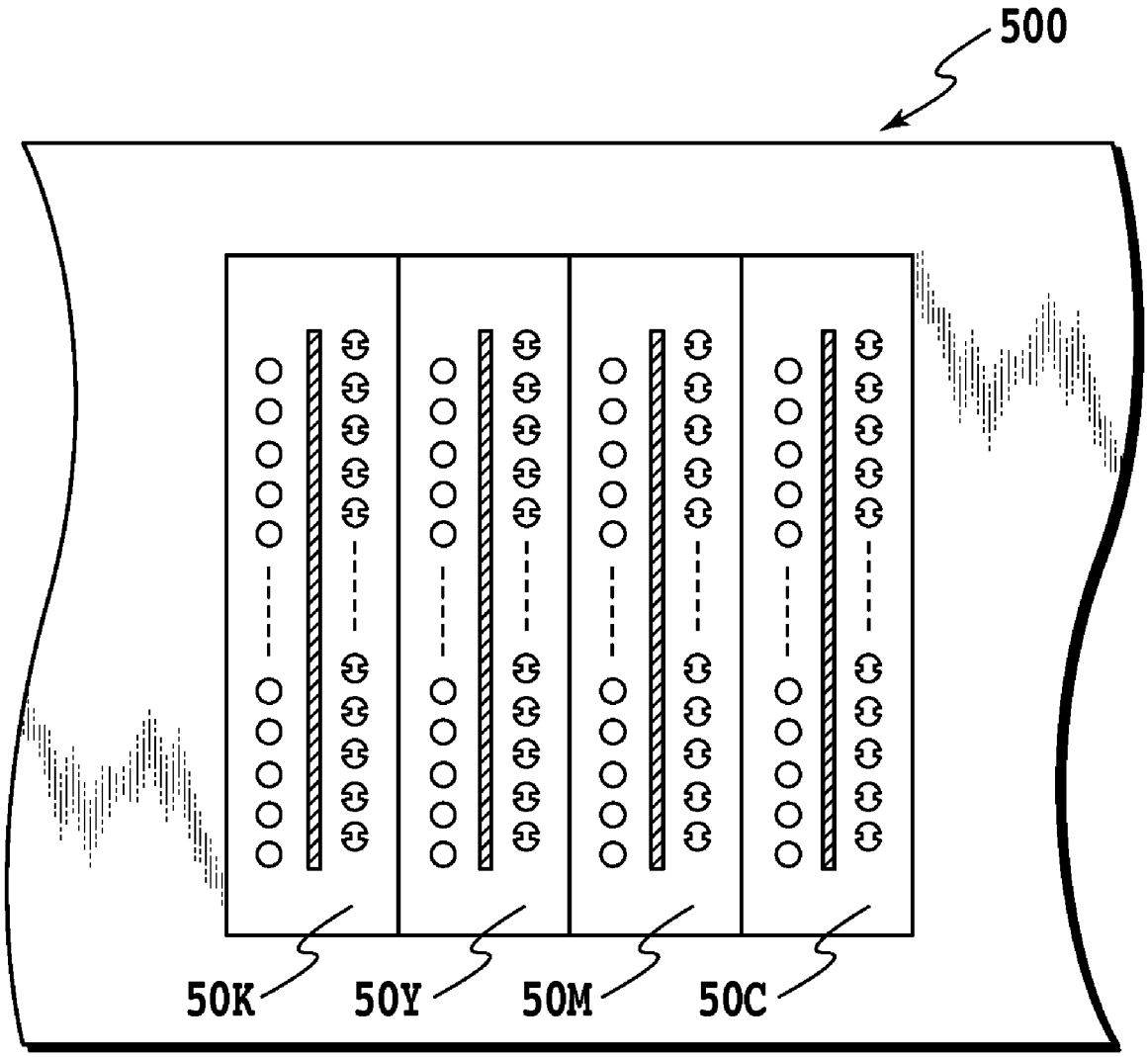
FIG. 14 is a schematic top view of a nozzle portion of a liquid ejecting head according to a fourth embodiment.

FIG. 14 is a schematic top diagram of a nozzle portion of a liquid ejecting head 500 according to the present embodiment. The liquid ejecting head 500 according to the present embodiment has an ejection opening column through which a liquid of the same color is ejected and which comprises circular ejection openings through which a small amount of liquid is ejected and ejection openings with projections through which a large amount of liquid is ejected. The remaining part of the basic configuration is similar to those of the above-described embodiments.

With a small amount of droplets ejected, the small amount of the liquid results in a relatively small number of satellites generated. However, in this case, the reduced size of each ejection opening increases the flow resistance and thus the likelihood of inappropriate ejection. With a large amount of droplets ejected, the large amount of the liquid results in a large number of satellites generated. However, in this case, the increased size of each ejection opening reduces the flow resistance and thus the likelihood of inappropriate ejection.

Thus, the liquid ejection head is configured such that the circular ejection openings, offering the smaller flow resistance, are used to eject a small amount of liquid, whereas the ejection openings with the projections, making it possible to inhibit the generation of satellites, are used to eject a large amount of liquid.

The liquid ejecting head configured as in the present embodiment also enables a reduction in the amount of mist generated. A liquid ejecting head has thus been successfully provided which makes it possible to inhibit inappropriate ejection and to achieve printing with improved image quality and reliability.

For the ejection openings with the projections according to the present embodiment, the projections may be long or short. Preferably, the length of the projections may be appropriately varied depending on the liquid used for printing.

Furthermore, the length of the projections in the ejection openings with the projections, shown in the above-described embodiments, is not limited to the above-described value and may be appropriately varied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-139178, filed May 25, 2007, which is hereby incorporated by reference herein in its entirety.

What is claimed is:

1. A liquid ejection head comprising:

a first ejection opening column comprising a plurality of first ejection openings ejecting a first liquid, a second ejection opening column comprising a plurality of second ejection openings ejecting a second liquid different from the first liquid, wherein the plurality of first ejection openings are circular and the plurality of second ejection openings have two mutually opposing and inwardly extending projections and two semicircular parts.

2. The liquid ejection head according to claim 1, further comprising a third ejection opening column comprising a plurality of third ejection openings ejecting a third liquid that is different from the first liquid and the second liquid, wherein the plurality of third ejection openings have two mutually opposing and inwardly extending projections that are longer than the projections of the second ejection openings.

* * * * *